United States Patent [19]

Lustig

[11] Patent Number: 4,467,325

[45] Date of Patent: Aug. 21, 1984

[54] ELECTRO-OPTICALLY ADDRESSED FLAT PANEL DISPLAY

[75] Inventor: Claude D. Lustig, Lexington, Mass.

[73] Assignee: Sperry Corporation, New York, N.Y.

[21] Appl. No.: 317,688

[22] Filed: Nov. 2, 1981

[51] Int. Cl.[3] ..... G09G 3/00

[52] U.S. Cl. ..... 340/794; 340/781; 340/719; 250/213 A

[58] Field of Search ..... 340/794, 781, 718, 719; 250/213 A

[56] References Cited

U.S. PATENT DOCUMENTS

| | | | |
|---|---|---|---|
| 2,900,574 | 8/1959 | Kazan | 340/781 |
| 3,154,720 | 10/1964 | Cooperman | 340/781 |
| 3,270,206 | 8/1966 | Kazan . | |
| 3,575,634 | 4/1971 | Kohashi | 340/794 |
| 3,940,757 | 2/1976 | Purchase | 340/794 |
| 3,947,842 | 3/1976 | Hilsum et al. | 340/794 |

OTHER PUBLICATIONS

*Electroluminescent Display and Logic Devices,* Greenberg Electronics, 3/24/61, pp. 31–35.

*Primary Examiner*—Marshall M. Curtis
*Attorney, Agent, or Firm*—Howard P. Terry

[57] ABSTRACT

A flat panel display in which a matrix array of electro-sensitive pixel elements organized in rows and columns are coupled to photosensitive devices such as photoresistors. The photoresistors are in turn coupled to X and Y addressing leads which contain X and Y alphanumeric or graphic information to be displayed in the matrix array. The photoresistors are illuminated with light sources substantially in synchronism with signals present on the X or Y addressing leads. Upon illumination by a scanning light source such as a self-scanning gas discharge device, the photoresistor's resistance drops and permits the information on the X and Y addressing leads to be coupled to the appropriate pixel. Addressing of large flat panel displays using as few as two driver circuits for the X and Y leads and as few as four driver circuits for the self-scanning gas discharge device is thus possible.

17 Claims, 21 Drawing Figures

ELECTRO-OPTICALLY ADDRESSED FLAT PANEL DISPLAY

BACKGROUND OF THE INVENTION

1. Field of the Invention

This invention pertains to the field of flat panel displays and more specifically to a flat panel display that utilizes electrooptic techniques to minimize the required addressing circuitry.

2. Description of the Prior Art

Flat panel displays are useful for the display of alphanumeric and graphic information in applications including computer readouts, plotting and tracking displays and the like. Such displays are lighter in weight than CRT displays and due to their flat panel construction may be placed in consoles having a more limited depth than required for CRT's.

Most flat panel displays utilize an array of small discrete electro-sensitive areas known as pixels, that either generate light or reflect light in response to an electrical signal. The pixels may comprise a.c. or d.c. electroluminescent material, gas discharge cells, light emitting diodes, liquid crystals, etc., and may be addressed either individually, or in a matrix array with half-select techniques. Displays of practical size, however, require a large number of addressing circuits even when organized in a matrix array, thereby significantly increasing the cost and complexity of the resulting display system. For example, a flat panel display containing 10,000 pixels in a 100 by 100 row and column configuration would require up to 10,000 individual circuits for each pixel in a direct addressing system. Most matrix organized flat panel displays, however, utilize a row and column addressing system in which the pixels in an individual row have a lead in common, and the pixels in each column also have a lead in common. Thus, by addressing the appropriate column and row, individual pixels may be energized. For the previous examples of the 100 by 100 matrix display, 200 addressing circuits would be required, 100 for the rows and 100 for the columns. The present invention provides for a greatly reduced number of addressing circuits useful in conjunction with display media that have a steep brightness voltage threshold, such as, for example, electroluminescent materials and display media having a steep brightness voltage threshold and inherent memory, such as d.c. plasma panels.

SUMMARY OF THE INVENTION

A flat panel display embodying the principles of the present invention comprises a matrix array of electrosensitive pixel elements coupled in rows and columns which in turn are coupled to photosensitive devices. The photosensitive devices, which are further coupled to X or Y addressing leads, are illuminated with light sources substantially in synchronism with voltage signals present on the X or Y addressing leads, such voltage signals corresponding to information desired to be displayed. On illumination the photosensitive devices will enable selected pixels to be energized. Should a voltage signal be present on the appropriate X or Y addressing lead substantially simultaneously with the enabling of a pixel, then that pixel will be energized.

In the preferred embodiment, the photosensitive devices comprise resistive dividers in which at least one element is a photoresistor, the resistance of which decreases significantly upon illumination, thus substantially applying the voltage on the addressing lead to a pixel row or column. The photoresistors may be illuminated sequentially by scanning light source such as a self-scanning gas discharge device.

DESCRIPTION OF THE PREFERRED EMBODIMENTS

Figure 1:
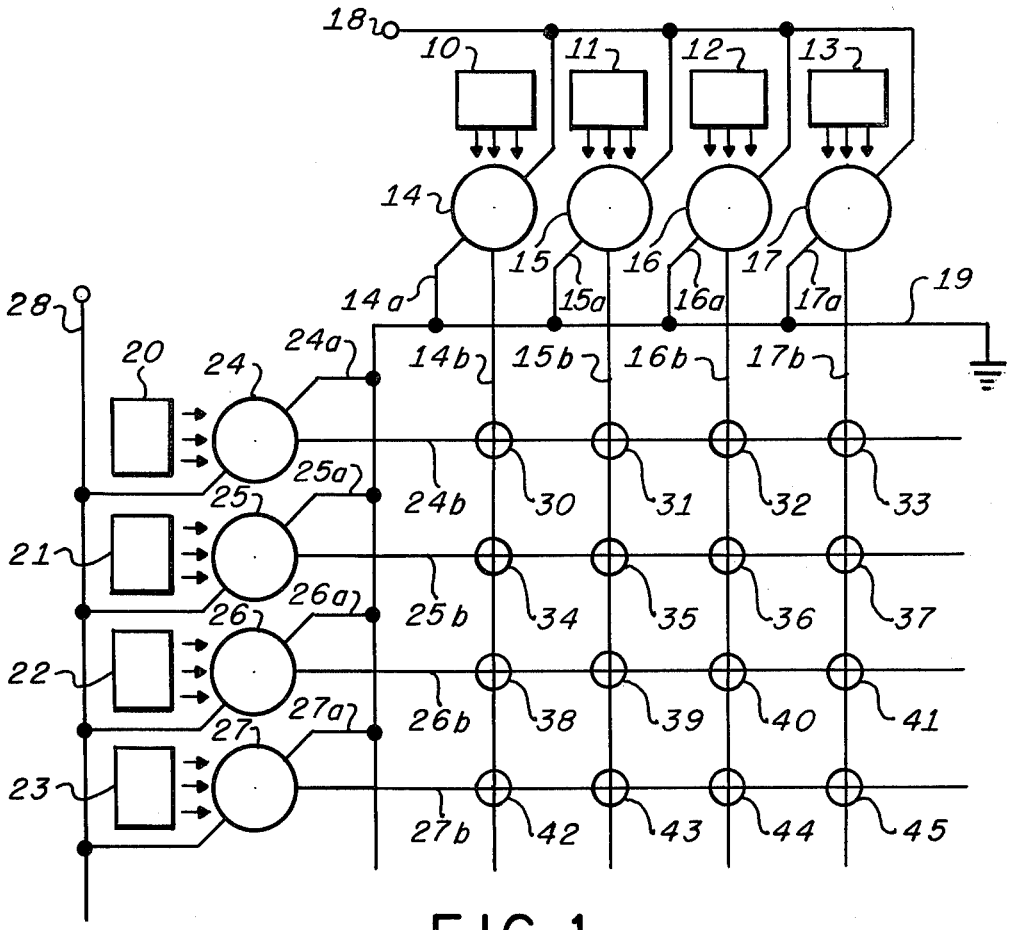
FIG. 1 is a schematic representation of the invention.

Referring to FIG. 1, a basic flat panel display addressing scheme is shown including light sources 10 through 13, each being disposed in alignment with photosensitive devices 14 through 17, respectively. Photosensitive devices 14 to 17 are in turn coupled to lead 18 which transmits X coordinate or column information and further include leads 14*a*, 15*a*, 16*a* and 17*a* coupled to ground lead 19. In a similar manner, the Y coordinate or row addressing circuitry comprises light sources 20 through 23 which are aligned respectively with photosensitive devices 24 through 27 which are in turn coupled to Y information lead 28 and further have leads 24*a*, 25*a*, 26*a* and 27*a* coupled to ground lead 19. Each photosensitive device 14 through 17, and 24 through 27 inclusive have additional leads 14*b* through 17*b* and 24*b* through 27*b*, respectively, which are in turn coupled to pixels 30 through 45. Pixels 30 through 45 may comprise any electrosensitive display media that has a steep brightness-voltage threshold and can be addressed by voltage pulses of only a few microsecond duration. Thin film a.c. electroluminescent (EL) material, widely known in the art is an example of a medium of this type. Another display medium having steep brightness-voltage threshold is the a.c. plasma panel. These panels, which have an inherent memory may be used if provision is made for applying an a.c. sustaining voltage to the display together with the addressing voltages.

In operation, light sources 10 through 13 and 20 through 23 may be selectively illuminated causing an activation of the desired pixel. For example, if one desired to illuminate pixel 35, light source 11 should be energized to illuminate photosensitive device 15 and light source 21 should simultaneously illuminate photosensitive device 25, which enables pixel 35. In order, however, for pixel 35 to be energized, it is further necessary to couple an electrical signal to leads 18 and 28. In one embodiment of the invention, pulses coincident in time, but having opposite polarity are applied to leads 18 and 28 and as a result of which, pixel 35 is energized.

Photosensitive devices 14 through 17 and 24 through 27 coupled to the matrix of pixels are selected to permit the voltage amplitude on the corresponding leads **14*b* to 17*b* and 24*b* to 27*b* to increase to a value close to the voltage which has been applied to lead 18 or 28, when the photosensitive devices are illuminated. In the absence of the external illumination, the display line voltage on leads 14*b* through 17*b* and 24*b* through 27*b* is held close to ground, even if a voltage is present on leads 18 or 28**.

The panel is addressed by voltage pulses which are applied to leads 18 and 28 in synchronism with pulses of light which illuminate the photosensitive devices in the X and Y arrays. Light source 20 is first energized to illuminate the photosensitive device 24, and a negative voltage $-V$ is applied to lead 28. This charges the row electrode **24*b* to a voltage potential close to $-V$ while the other rows remain at approximately ground potential. Substantially simultaneously, light source 10 is energized to illuminate photosensitive device 14. If pixel 30 at the intersection of the column coupled to photosensitive device 14 and the row coupled to photosensitive device 24 is to become luminous, a positive voltage pulse V is applied to lead 18. The column electrode 14 is charged to substantially V volts while the remaining columns are at substantially ground potential. If voltage V has been chosen such that 2 V is above the threshold voltage for light emission from the display medium but V is below the threshold, and furthermore if the voltage brightness curve for the electroluminescent material is sufficiently steep such that voltage V applied to the medium causes substantially no light emission, then only pixel 30 is luminous. If the information to be displayed on the panel requires that pixel 30 be non-luminous, then a positive voltage pulse is not applied to lead 18 at the time light source 10 is energized and pixel 30 remains in a "half select" condition in the same manner as all other pixels in the row coupled to photosensitive device 24**.

Light source 10 is then extinguished and light source 11 energized to illuminate photosensitive device 15. If pixel 31 is to become luminous, a positive voltage pulse will be applied to lead 18; if pixel 31 is to remain in an unlit condition, the voltage pulse is omitted. This process may be continued until all other pixels in the row of pixels coupled to photosensitive device 24 have been addressed. The light source 20 is then extinguished and light source 21 energized illuminating the photosensitive device 25. Light sources 10 through 13 may then be sequentially energized to respectively illuminate photosensitive devices 14 through 17 in synchronism with positive voltage pulses applied on lead 18. The procedure is repeated for the remaining rows until the entire panel has been addressed at which time the process may be repeated in order to refresh or change the information displayed on the panel.

Figure 2:
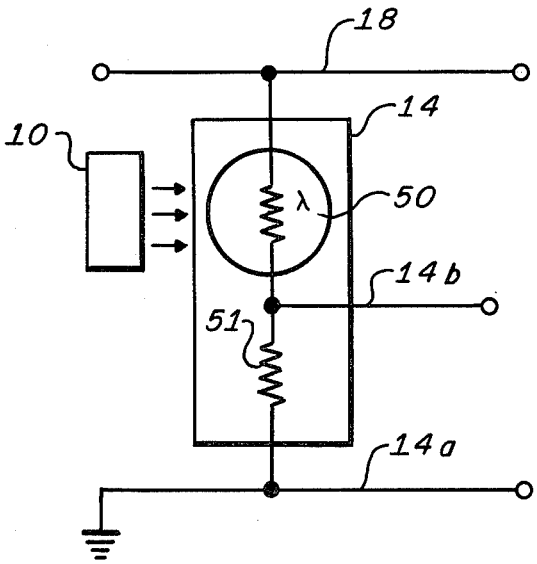
FIG. 2 is a schematic representation of a photosensitive device utilized in the invention.

Photosensitive devices 14 through 17 and 20 through 23 may include many different types of opto electronic devices including, for example, planar silicon phototransitors, photo-diodes, or photoresistors. Photoresistors comprised, for example, predominantly of cadmium sulfide (CdS) or cadmium selenide (CdSe) or a combination of the two are advantageous in that they may be directly deposited in powdered form by silk screening onto a glass display panel substrate and superimposed on or located beneath the conductive lines so that no subsequent interconnections are necessary. The CdS or CdSe photoresistors may also be deposited by evaporation or sputtering. Refer now to FIG. 2 wherein photosensitive device 14 is shown that is comprised of photoresistor 50 and resistor 51. Photoresistor 50 and fixed resistor 51 form a voltage divider, which for an input voltage of $V_o$, has an output:

$$V = V_o \frac{R_f}{R_f + R\lambda} \tag{1}$$

where $R_f$=the resistance of the fixed resistor; and $R\lambda$=the resistance of the photoresistor.

Figure 3:
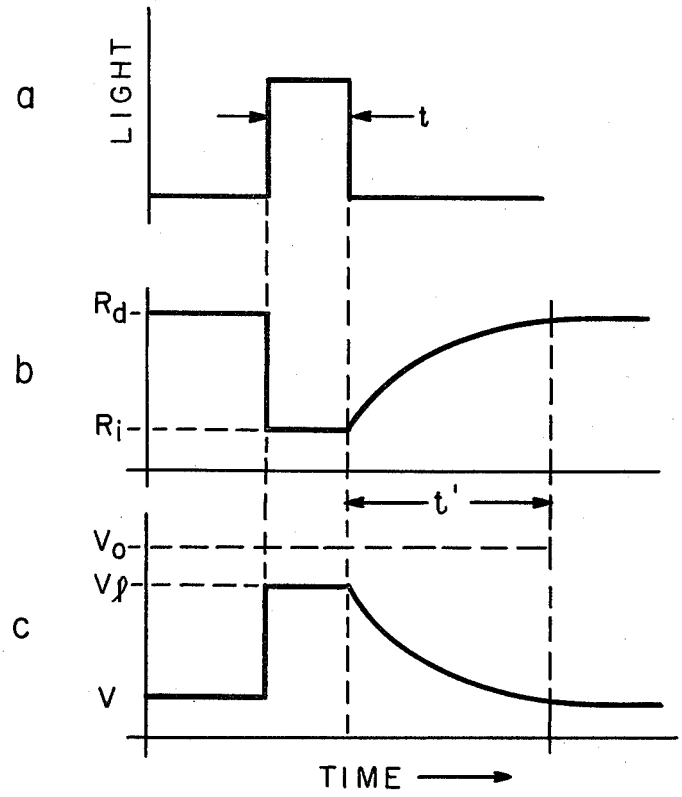
FIGS. 3A, 3B and 3C are waveforms useful in explaining the operation of the invention.

Referring to FIG. 3A, photoresistor 50 is illuminated by a light pulse having a predetermined duration $\tau$. Upon exposure to the light pulse, the resistance of photoresistor 50 will decrease from a high value dark resistance $R_d$ to a lower value illuminated resistance $R_l$ as shown in FIG. 3B. Choosing $R_f$, $R_l$ and $R_d$ such that $R_1 < R_f < R_d$, the output voltage V will take the form shown in FIG. 3C increasing from a value $V_d$ before the light source 10 is energized, to a value $V_l$ after the light source is energized. $V_d$ and $V_l$ may be determined as follows:

$$V_d = V_o \frac{R_f}{R_f + R_d}; V_l = V_o \frac{R_f}{R_f + R_l} \tag{2}$$

where $R_d$=the photoresistor's non-illuminated resistance.

$R_l$=the photoresistor's illuminated resistance.

For example, if $R_d = 10\ R_f = 100\ R_l$, then $V_d = .09\ V_o$, and $V_l = 0.91\ V_o$.

As indicated in FIGS. 3B and 3C, a significant time interval $\tau'$ is generally required for the conductance of the photoresistor to return to its dark value and subsequently for the voltage V to decay towards the dark value $V_d$.

If instead of a d.c. voltage, the input voltage of the divider circuit is replaced with a voltage pulse that is synchronized with the light pulse and having an amplitude $V_o$ and a duration $\tau'' \leqq \tau$, then the output voltage will be a voltage pulse having substantially the same duration $\tau''$, and amplitude $V_l$. If, however, the voltage pulse occurs after $R\lambda$ has decayed to approximately the value $R_d$, then the output voltage will have an amplitude $V_d$.

The individual photoresistors in the display matrix may be illuminated by corresponding individual light sources, for example, LED's or electroluminescent segments driven by appropriate circuitry. The LED's or electroluminescent segments may be addressed in a matrix themselves, to minimize the drive circuitry needed for these sources of illumination. Alternatively, scanning may be accomplished, for example, using a laser and a mirror system in which the laser light is reflected to a parabolic mirror from a movable mirror mounted on a a galvanometer movement and located at the focus of the parabola. The light reflected from the parabolic mirror may then be further reflected from a straight strip reflector which in turn illuminates the arrays of photoresistors. Other schemes will be apparent to those skilled in the art.

A self-scanning gas discharge tube however is particularly suitable for this purpose since it can provide sequential illumination of the adjacent photoresistors with a minimum of drive circuitry, in a commercially available, compact, package. One such scanning discharge light source is the Burroughs BG 16101-2 dual linear bar graph display, manufactured by the Burroughs Corporation, Electronic Components Division, P.O. Box 1226, Plainfield, N.J. 07061. In these self-scanning gas discharge tubes, a glow transfer mechanism is used to shift a luminous glow repeatedly along an array of small cathode elements. The tubes require only four drivers, one of which is used for a scan initiate function.

Figure 4:
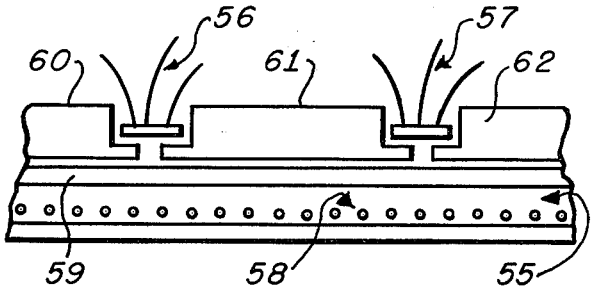
FIG. 4 shows a particular structure useful in illustrating the principles of the invention.

FIG. 4 shows an arrangement in which self-scanning discharge tube 55 is aligned with discrete photoresistors 56 and 57 for the illumination thereof. A glow will be transferred along cathodes 58, according to principles well known in the art. Opaque structures 60, 61, and 62 are used to prevent illumination of adjacent photoresistors by the same cathode element. Envelope 59 is comprised of a transparent material, typically glass, which contains the environment necessary to permit glow-transfer. For many practical display panel addressing applications, scanning gas discharge tubes with specially designed cathode configurations will be required.

Using a self-scanning gas discharge tube to replace light sources 10–13 and 20–23 in FIG. 1, a display panel can, in principle, be addressed with only ten drive circuits, namely, four circuits for each gas discharge tube and two circuits for the X and Y leads. Since, however, only one cell is addressed at a time, a panel of practical size, for example, 10,000 pixels refreshed at a rate of approximately 50 frames per second, will need to be addressed with a time of at most 0.5 microseconds per pixel. Noninstantaneous photoresistor response times as well as RC time constants arising from the finite capacitance of the electroluminescent panel make such a fast addressing time difficult to achieve. Thus, variations of the basic addressing scheme are required for display panels containing large numbers of pixels.

Figure 5:
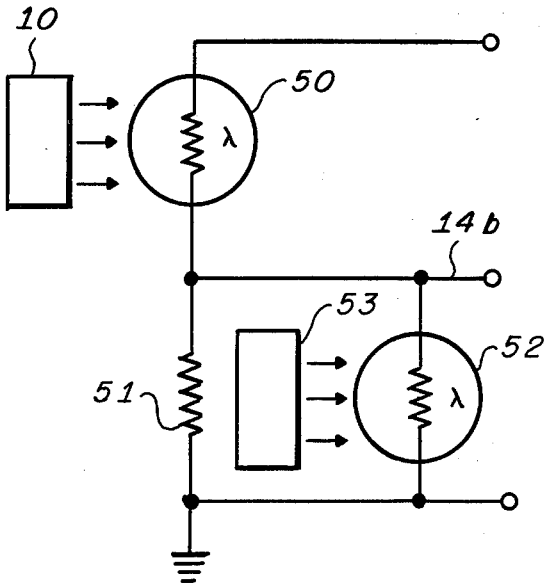
FIG. 5 shows an embodiment of a voltage divider used in the invention.

Refer now to FIG. 5 wherein a second photoresistor 52 and second light source 53 is introduced into photosensitive device 14 of FIG. 2. Photoresistors 50 and 52 are coupled in series relation between the voltage input lines and ground, photoresistor 52 being in parallel with resistor 51. Light sources 10 and 53 are used to illuminate photoresistors 50 and 52, respectively. Lead **14*b* is coupled to the junction between photoresistors 50 and 52 and resistor 51 and is coupled to a column of pixels as previously shown in FIG. 1**.

Figure 6:
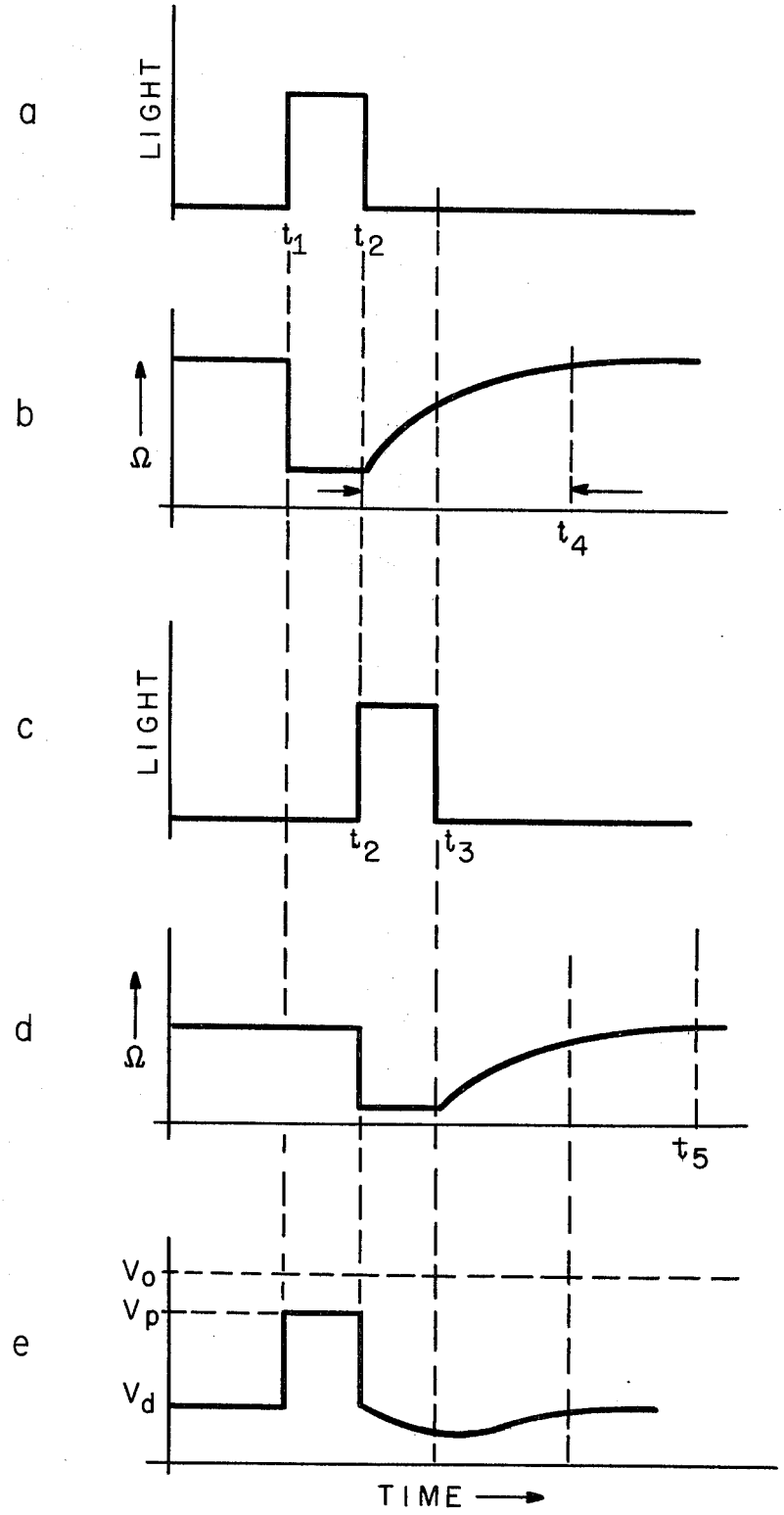
FIG. 6 shows waveforms useful in explaining the operation of the invention.

Referring to FIG. 6, in operation, photoresistor 50 is illuminated by a light pulse from light source 10 in FIG. 6A beginning at time $t_1$ and ending at time $t_2$. Photoresistor 50 will exhibit a resistance shown in FIG. 6B in a similar manner to that shown in FIG. 3B, having a decay time such that photoresistor 50 does not return to substantially its dark resistance until time $t_4$. As will be explained below, in operation resistor 51 is not required, and its effect will not be considered. Photoresistor 52 is illuminated with a light pulse beginning at time $t_2$ and ending at time $t_3$ as shown in FIG. 6C. The resistance exhibited by photoresistor 52 under such conditions of illumination are shown in FIG. 6D which decays in a manner similar to that shown for photoresistor 50 in FIG. 6B, such that its resistance does not substantially return to the dark resistance value until time $t_5$. FIG. 6E shows the resultant voltage that thus appears on lead **14*b*. Photoresistor's 52 variable resistance has the effect of shunting voltage appearing across photoresistor 50 during the decay time to ground potential thus decoupling voltages appearing across photoresistor 50 from lead 14*b*, when decoupling photoresistor 52 is illuminated. In this manner, the voltage pulse shown in FIG. 6E substantially similar to the initial light pulse used to illuminate the photoresistor 50 as shown in FIG. 6A appears on display line 14*b***.

Fixed resistor 51 may be eliminated since within a few frame times of start up the time varying resistance of photoresistor 52 will be reproduced from frame to frame. The initial resistance of photoresistor 52 can thus be chosen appropriately permitting a substantial simplification of panel fabrication. It is assumed that the resistances of photoresistor 50 and decoupling photoresistor 52 are not identical, the resistance of photocell 50 being greater than that of photoresistor 52. For an input voltage $V_o$, the output voltage of the divider circuit may be stated as $$V = V_o \frac{R'(t)}{R(t) + R'(t)}$$

where R'(t) is equal to the resistance of photoresistor 52 and R(t) is equal to the resistance of photoresistor 50. It will be clear to those skilled in the art that proper selection of the resistance values of and illumination levels for photoresistors 50 and 52 will yield an optimum ratio of pulse amplitude $V_p$ to base line value $V_b$ as shown in FIG. 6E.

With the introduction of second photoresistor 52 and its associated light source 53, the output of the voltage divider circuit becomes substantially independent of the long photoresistor decay time shown in FIGS. 6B and 6D. It is still necessary, however, to keep the decay time as short as possible, because immediately after the photoresistor 52 has been illuminated, a relatively low resistance path between the input voltage source and ground exists. Power dissipation in these photoresistors may become unacceptably large if the resistances of photoresistors 50 and 52, for example, do not increase fairly rapidly after their illumination has ended, since voltage pulses used to address other lines in the display will also appear across these photoresistors. The self-scanned discharge tubes used as light sources 10 and 53 can be operated using the same driver circuitry, thus the use of the additional set of light sources does not increase the number of external circuits.

The rate at which information may be fed to the display panel of the instant invention may be increased if the rows and columns in the display are addressed through sets of leads for the rows and columns instead of the individual leads 18 and 28 shown in FIG. 1. Such an arrangement is shown in FIG. 7 for an alphanumeric panel, although it will be clear to those skilled in the art that it is applicable to any panel with graphic capability.

Figure 7:
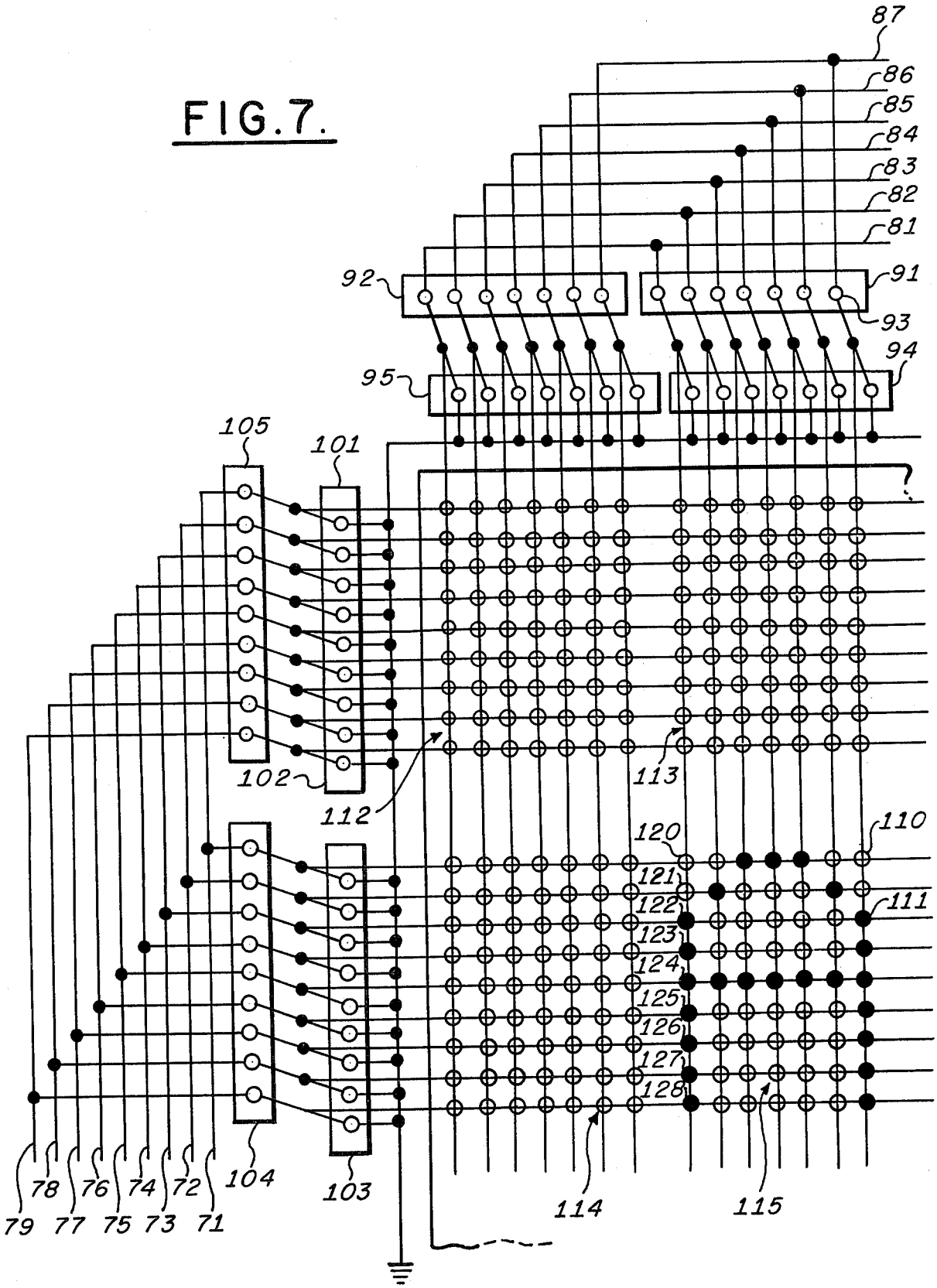
FIG. 7 is a schematized diagram illustrating a preferred embodiment of the invention.

Refer now to FIG. 7 wherein a corner of a panel is shown having m rows and n columns of characters in which each character is displayed in a 9×7 dot matrix array. Four such characters 112, 113, 114 and 115 are shown in FIG. 7. Corresponding rows and columns of the 9×7 arrays are accessed through common leads as shown, such that there are nine Y addressing leads, 71 through 79 for the horizontal rows and seven X addressing leads 81 through 87 for the vertical columns. Groups of 9 and groups of 7 photoresistors are illuminated by extended light sources thus enabling all pixels in a particular 9×7 dot matrix. Extended light sources 91 and 92 are used to illuminate the photoresistors corresponding to the X leads 81 through 87 for coupling information appearing thereon to the appropriate X columns appearing in 9×7 matrices. Photoresistors are shown as open circles, for example photoresistor 93 is amongst the group of seven illuminated by extended light source 91. Extended light sources 94 and 95 illuminate decoupling photoresistors which correspond in function to photoresistor 52 of FIG. 4 and are used to enhance the decay time of voltage pulses appearing on the leads to the pixels in the matrix array. In accordance with the discussion of FIG. 5, the judicious selection of initial values for the photoresistors 50 and 52 permits, as shown in FIG. 7, the elimination of resistors corresponding to resistor 51 of FIG. 5.

Non-luminous pixels are represented for clarity as circles surrounding the intersection of the respective addressing lines, for example, pixel 110, while luminous pixels will be shown as solid circles, for example pixel 111. Extended light sources 104 and 105 are used to illuminate groups of nine photoresistors in a manner similar to that in which extended light sources 91 and 92 are used to illuminate groups of seven X photoresistors. Similarly, extended light sources 101 and 103 are used to illuminate decoupling photoresistors in the same manner as extended light sources 94 and 95. For example, photoresistor 102 is amongst the group of nine illuminated by extended light source 101.

In operation, extended light sources 105 and 92 are energized with a voltage pulse so that the rows and columns which intersect in the top left character 112 are coupled to Y leads 71 through 79 and X leads 81 through 87. The character may then be addressed one column at a time with a voltage pulse being applied to lead 81 while pulses of opposite polarity are applied to as many of leads 71 through 79 as are required to light up the desired pixels. The voltage pulse is then applied to lead 82 and leads 71 through 79 are readdressed. The process is repeated for the remaining leads 82 through 87 until the entire character is displayed. It will be recognized that the character may also be addressed one row at a time if desired. Extended light source 92 may then be extinguished and extended light sources 95 and 91 energized. Extended light source 95 and its associated photoresistors decouple the first character 112 column while the light from extended light source 91 illuminates its associated photoresistors to couple the second character column to the seven input leads 81 through 87. Character 113 is then addressed a column at a time after which the extended light source 95 and extended light source 91 are extinguished and extended light source 94 and the extended light source associated with the coupling photoresistors for the third character (not shown in FIG. 7) are energized so that the third character can be addressed. This procedure is continued until the whole of the first row of characters has been displayed. At this point, extended light source 105 is extinguished and extended light sources 101 and 104 are energized to provide access to the second row of characters beginning with character 114, which is then addressed in the manner described above. Note that extended light source 92 will be interconnected with the last of the column decoupling light sources, so that the last character column is decoupled as the first character column is readdressed. Similarly, extended light source 105 is interconnected with the last of the row decoupling light sources so that the last character row is decoupled as refresh of the panel starts at the first character row.

Figure 8A:
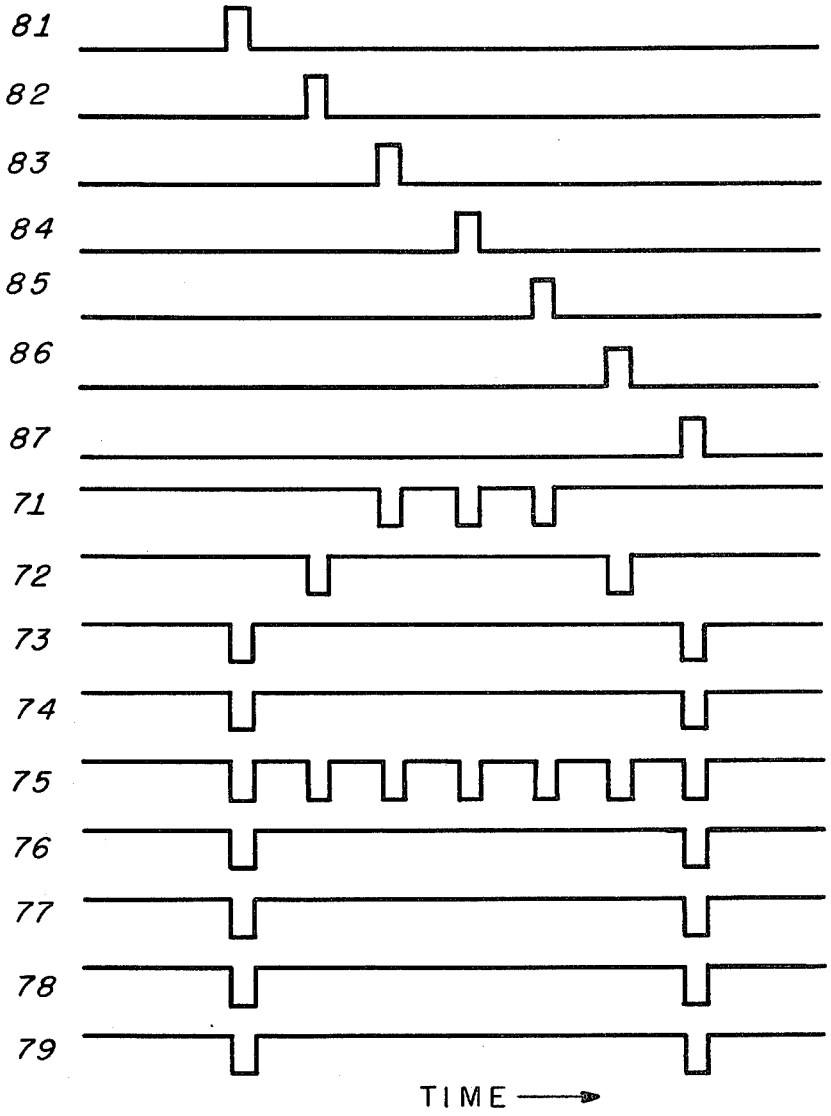
FIGS. 8A and 8B are waveforms useful in explaining the operation of the invention.

In a specific example of the addressing process, seven pixels 122 through 128 in the first column of the letter A in character 115 are made luminous when extended light sources 104, 101, 91 and 95 are energized, a voltage pulse being applied to lead 81 and voltage pulses of opposite polarity being applied to leads 73 through 79 as is shown in FIG. 8A wherein the numbers to the left of each waveform correspond to the leads in FIG. 7.

Using nine parallel leads to address the rows of the display panel permits addressing nine pixels simultaneously. For a fixed applied voltage pulse length T, this will give a nine-fold increase in the rate with which information may be displayed compared to a display in which only one pixel is addressed at a time, thus permitting a substantial increase in the amount of information that may be addressed to a display panel. It is clear that using more than nine parallel leads to address the rows of the display panel will still further increase the rate at which information may be addressed to the panel. The principal use of seven parallel leads 81 through 87, to address the columns of a display is however, to reduce power dissipation in the photoresistor array. In a display where each column is individually addressed, a single Y-lead such as lead 18 in FIG. 1 will present a voltage pulse to all the photoresistor voltage divider circuits connected to the Y-lead, thus currents to ground will be generated in all the column voltage divider circuits. The currents in those circuits in which the photoresistors were recently illuminated will be quite large since the conductance of those photoresistors will not yet have decayed down to a low value. Since they are electrically in parallel, a number of such divider circuits in various stages of decay will present a low impedance load and subsequently high power consumption. Increasing the number of parallel leads to address the display columns to seven, reduces the number of columns connected to each voltage pulse carrying lead by approximately a factor of seven, thus increasing the impedance which the voltage pulse sources see. Similarly, if more than seven parallel leads are used to address the display columns, then the impedance which the voltage pulse sources see is still further increased and the power consumption correspondingly reduced.

Additionally, use of extended light sources such as 91 through 95 and 101 to 105 to illuminate groups of photoresistors minimizes the requirement for high resolution, high intensity illumination of individual photoresistors. It will be obvious to those skilled in the art that illumination of groups of photoresistors with a scanning gas discharge source may be accomplished with gas discharge sources in a separate envelope without an excessive amount of optical crosstalk through the use of an appropriate layout.

Figure 8B:
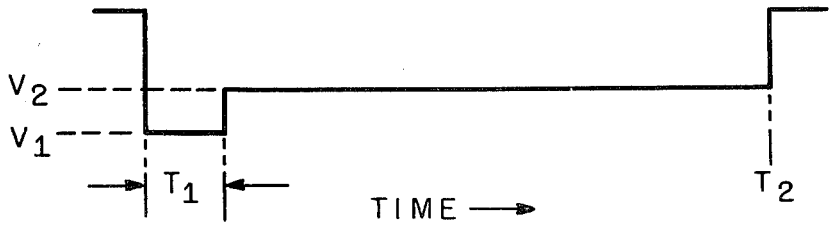

Referring now to FIG. 8B, in order to display the letter A in character 113 as described above, it is advantageous to energize light sources 92 and 95 with a twostep voltage, shown therein. A high voltage level $V_1$ may be applied for a time period $T_1$ to obtain an intense light pulse that will cause a rapid increase in the conductance of the photoresistors. The voltage may then be reduced to a lower level $V_2$, to provide a lower level of illumination that is sufficient to hold the conductance of the photoresistors at a constant value. During the period from the end of $T_1$ to time $T_2$ when the photoresistor conductances are fixed, seven voltage pulses having a predetermined pulse width are applied in succession to leads 81 through 87, while pulses of opposite polarity, but approximately the same pulse width are applied to leads 71 through 79 as previously described and shown in FIG. 8A. The polarity of the voltage pulses may be reversed every frame time when an a.c. type electroluminescent display material is utilized.

The maximum number of pixels in the display which can be addressed by the method shown in FIG. 7 is governed by the material properties of the display medium and the photoresistors. Important parameters include the threshold voltage and capacitance of the display medium as well as the decay time of the photoresistors. Conditions which must be met for any given display panel configuration are: (1) the average addressing time for a pixel must be sufficiently short so that all pixels can be addressed within one frame time; (2) the conductances of the photoresistors must be allowed to decay appreciably between the application of illuminating pulses; and (3) the power dissipation in the photoresistors must not exceed a reasonable level.

A new addressing cycle involving the re-illumination of a given photoresistor cannot be initiated until its resistivity has increased to a value approaching its dark resistance. This means that a time interval of the order of approximately $t_{4-t2}$ seconds as shown in FIG. 6 must be allowed to elapse before the light sources 91, 92, 95, etc. may be energized again. These sources are energized at intervals substantially equal to the length of time required to address a whole character row.

A voltage pulse applied to one of the leads to address the display panel will cause negligible power dissipation in the voltage divider circuit connected to the line being addressed. The power dissipated in the rest of the photoresistor array, connected to the lead, however, is significant, because parts of the array may present a low impedance load shortly after they have been illuminated, as explained above.

Each display line is capacitively coupled through a large number of pixels to the other display lines which are connected to ground through the arrays of photoresistors. This capacitance when taken with the resistance provided by the photoresistive dividers presents an RC time constant which limits the speed with which a pixel may be energized. The RC time constant may be minimized by reduction of the resistance or capacitance values.

If the resolution of the panel is increased, the pixel size and thus capacitance will be decreased. The decreasing capacitance will permit an increase in the value of the light resistance $R_l$ of the photoresistors while still maintaining the same RC constant. This will lead to a reduced value of energy dissipated in the voltage dividers. Thus, for a constant RC value, the dissipation in the photoresistors will be roughly proportional to the pixel capacitance.

Power dissipation will also be proportional to the square of the voltage used to address the panel and therefore a display medium which utilizes a lower voltage will minimize power consumption proportionately.

Figure 9A:
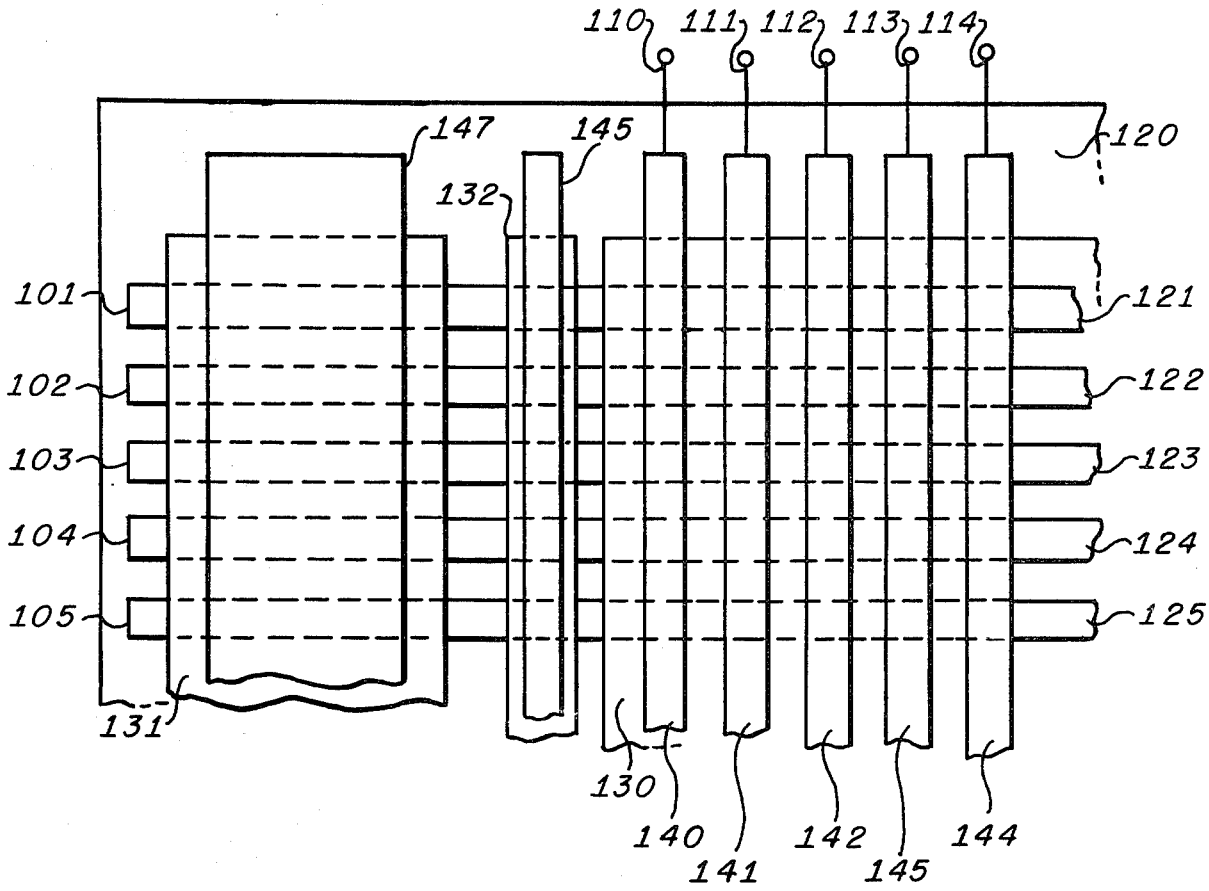
FIGS. 9A and 9B show construction of one embodiment of the invention.
Figure 9B:
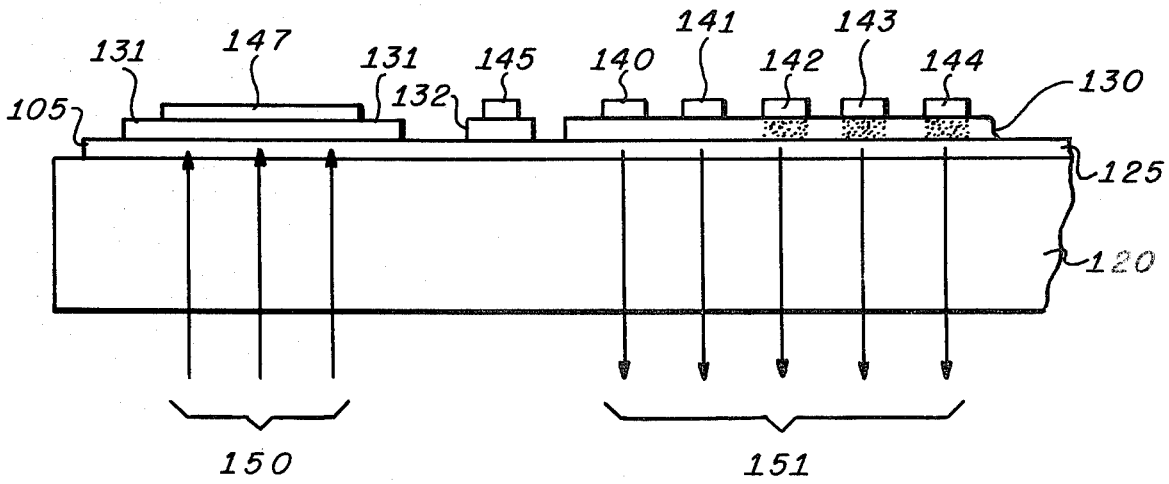

The nature of the photoconducting material and electroluminescent materials permits particularly simple and inexpensive fabrication of the desired display panel. FIG. 9A shows a view from the display side of such a panel wherein only the horizontal rows 101, 102, 103, 104 and 105 are addressed using the scanning gas discharge tube, while the vertical columns are addressed using appropriate driver circuitry coupled to leads 110, 111, 112, 113 and 114. The display of FIG. 9A is comprised of substrate 120 on which are deposited transparent electrodes 121, 122, 123, 124 and 125 corresponding to horizontal rows 101, 102, 103, 104 and 105. A layer of electroluminescent material 130 is laid over the transparent electrodes 120 through 125 in the area of the viewing screen while a layer of photoconducting material 131 is deposited to the side of the display area. Resistive material 132 is deposited between the photoconductor and electroluminescent material. Metal electrodes 140, 141, 142, 143 and 144 are then placed over the electroluminescent area and are coupled to leads 110, 111, 112, 113 and 114, respectively. Metal electrode 145 is deposited over resistive material 132. Metal electrode 147 is placed over photoconducting layer 131 to complete the construction. In this manner, transparent electrodes 121 through 125 in conjunction with metal electrode 147 and photoconducting layer 131 therebetween form photoresistors as hereinabove described while the remaining portion of transparent electrodes 121 through 125 form, in conjunction with electroluminescent layer 130 and electrodes 140 through 144, the pixel areas of the display panel. Metal electrode 145 in conjunction with resistive material 132 forms a fixed resistance. It will be clear to those skilled in the art that transparent electrodes are necessary both for the transmittal of light from the electroluminescent material and for transmittal of light to the photoconducting material. FIG. 9B shows a cross-sectional view of the display system described in FIG. 9A taken through section 9—9 where arrows 150 indicate the propagation of light from the scanning-discharge tube to the photoconducting layer and arrows 151 indicate the direction of propagation of light from the luminous electroluminescent layer. The regions of electroluminescent layer 130 located between, for example, metal conductors 142 and 143 and transparent conductor 125 will correspond to the pixels shown in FIGS. 1 and 7. Similarly, the photoconductor region between transparent conductors 121, 122, etc. and metal electrode 147 will correspond to the photoresistors shown in FIG. 2 and FIG. 7. The resistor region 132, in conjunction with transparent conductors 121, 122, etc. and metal electrode 145 forms a fixed resistor corresponding to resistor 51 of FIG. 2. Electrode 145 is coupled to ground, and the transparent bus lines form the junctions between the fixed resistors, the photoresistors, and the display pixels.

In another embodiment of the invention, metal electrodes 140 through 144, 145 and 147 may be deposited first onto the substrate 120, and the transparent electrodes 121 through 125 may be deposited after the electroluminescent material 130, the photoconducting material 131 and the resistive material 132 have been deposited.

In this embodiment, the light from the scanning discharge tube to the photoconducting layer is incident from the opposite side of the panel substrate and does not pass through the substrate; the light from the luminous electroluminescent layer is emitted in the opposite direction and also does not pass through the substrate.

Although FIG. 9 illustrates an embodiment of the panel in which only the display rows are addressed using a stepped light source, clearly similar construction techniques are applicable to a panel in which both the rows and columns are addressed through the use of such a light source, as is shown in FIGS. 1 and 7.

Optical crosstalk may be caused by the illumination of photoresistors adjacent to the photoresistor one desires to illuminate. Optical crosstalk may be minimized by selection of the cathode shape and arrangement in the scanning discharge tube. Ordinarily, the cathodes in a scanning discharge tube are arranged in the manner shown in FIG. 10A by cathodes 171 through 176. The cathodes are coupled to leads 171*a* through 176*a* to three phase driver circuitry coupled to leads 180, 181 and 182. An improved configuration, shown in FIG. 10B reduces the possibility of optical crosstalk. The sections of adjacent cathodes 191 through 196 near the center area are in close proximity, thus permitting the glow transfer mechanism on which the self-scan principle depends to occur. The light from the central section is prevented from reaching the photoresistors by means of opaque mask 197 shown in outline by the dashed lines. Cathodes 191, 193 and 195 having exposed areas to the left of its region will address half of the horizontal rows, while cathodes 192, 194 and 196 having cathodes with exposed areas to the right may be used to illuminate the remaining horizontal rows.

Figure 11:
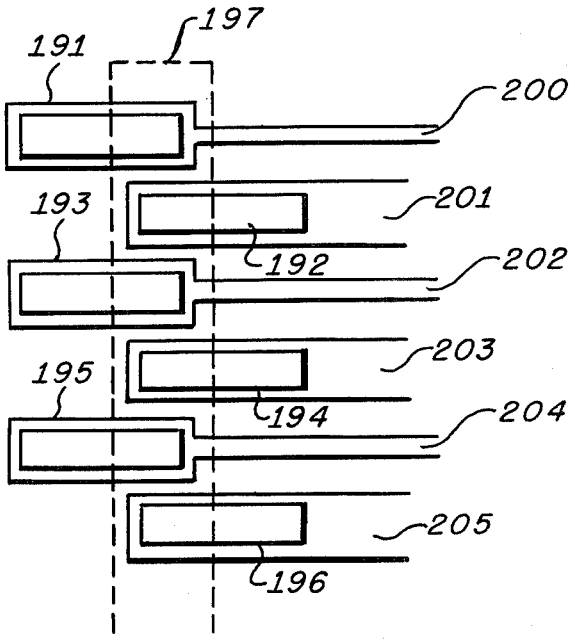
FIG. 11 shows an arrangement of electrodes useful in conjunction with the cathodes of FIG. 10B.
Figure 10A:
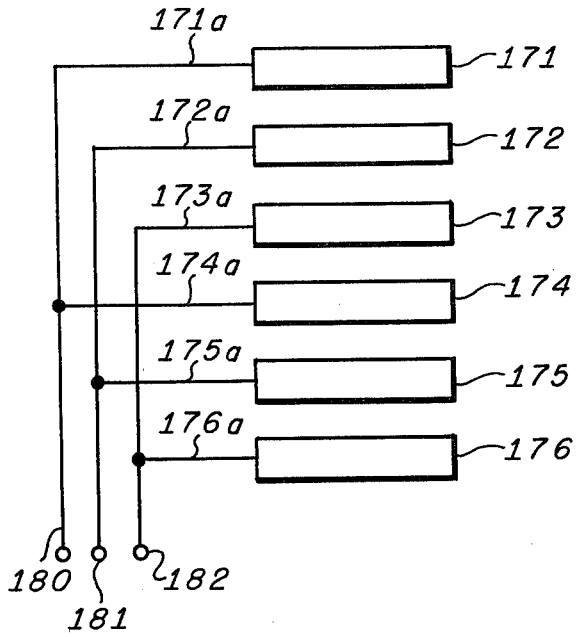
FIGS. 10A and 10B show arrangements of cathodes in scanning gas discharge devices useful in the present invention.
Figure 10B:
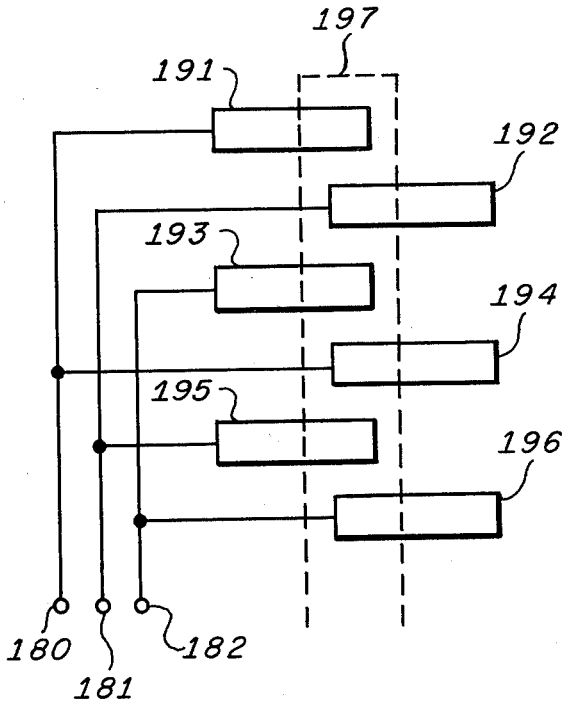

Crosstalk may be further minimized by the appropriate selection of the shape of the electrodes. One arrangement suitable for use with the cathodes of FIG. 10B is shown in FIG. 11 which includes electrodes 200, 201, 202, 203, 204 and 205 aligned with cathodes 191 through 196, respectively. Electrodes 200 through 205, which are adjacent to a photoconducting layer which is in turn adjacent to a metal electrode, will form photoresistors, as previously described, between the electrodes 201 through 205 and the metal electrode such as metal electrode 147 in FIG. 9. Transparent electrodes 200, 202 and 204 have been narrowed in a region displaced from cathodes 191, 193 and 195, respectively, in order to minimize the active photoresistor area which is nearest to the cathodes 192, 194, and 196. Since a photoresistor may still be formed in such region where the narrowing has taken place, it will be susceptible to light leakage from nearby cathodes. The structure shown in FIG. 11 will minimize the crosstalk that would otherwise occur by both minimizing the active photoresistor area and maximizing the distance of the photoresistor formed by the electrodes and the metal electrode in such area from the cathodes aligned with the other electrodes.

Figure 12A:
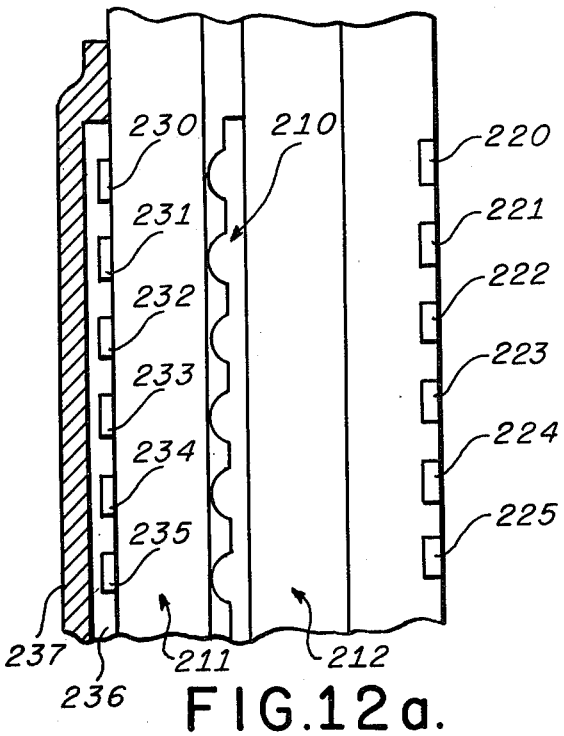
FIGS. 12A and 12B show construction of embodiments of the invention useful for minimizing optical crosstalk.

FIG. 12A shows another method by which optical coupling between the scanning gas discharge tube and the display panel may be optimized. Molded plastic lens structure 210 is sandwiched between the bottom of the glass panel substrate 211 and the surface of the gas discharge tube faceplate 212. The lenses may be used to focus light originating from cathodes 220 through 225 onto the corresponding transparent electrodes 230 to 235. Photoconductor layer 236 is then sandwiched between the transparent electrodes 230 to 235 and metal electrode 237.

Figure 12B:
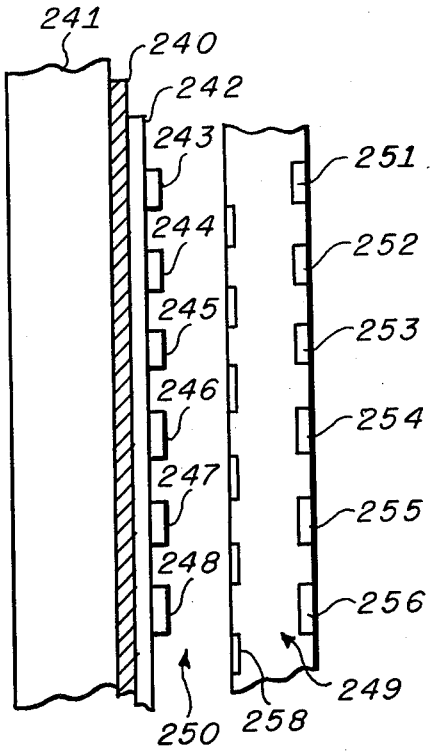

FIG. 12B shows another embodiment useful for obtaining efficient coupling between the scanning gas discharge tube and the display panel. Metal electrode 240 is deposited directly onto the panel substrate 241 and photoconductor layer 242 is sandwiched between metal electrode 240 and transparent electrodes 243 through 248. The gas discharge tube 249 is fitted with a fiber optic faceplate 250 which serves to guide the light from the cathodes 251 through 256 directly onto the transparent electrodes 243 through 248. An opaque mask 258 is located on the surface of the fiber optic faceplate 250 inside the gas discharge tube to further reduce optical crosstalk. The mask 258 could also be located at the other surface of fiber optic faceplate 250 between the faceplate and the transparent electrodes 243 through 248. The inside surface of the faceplate may also be coated with a transparent electrode which serves as an anode for the scanning gas discharge tube and is common practice for these tubes.

Figure 13A:
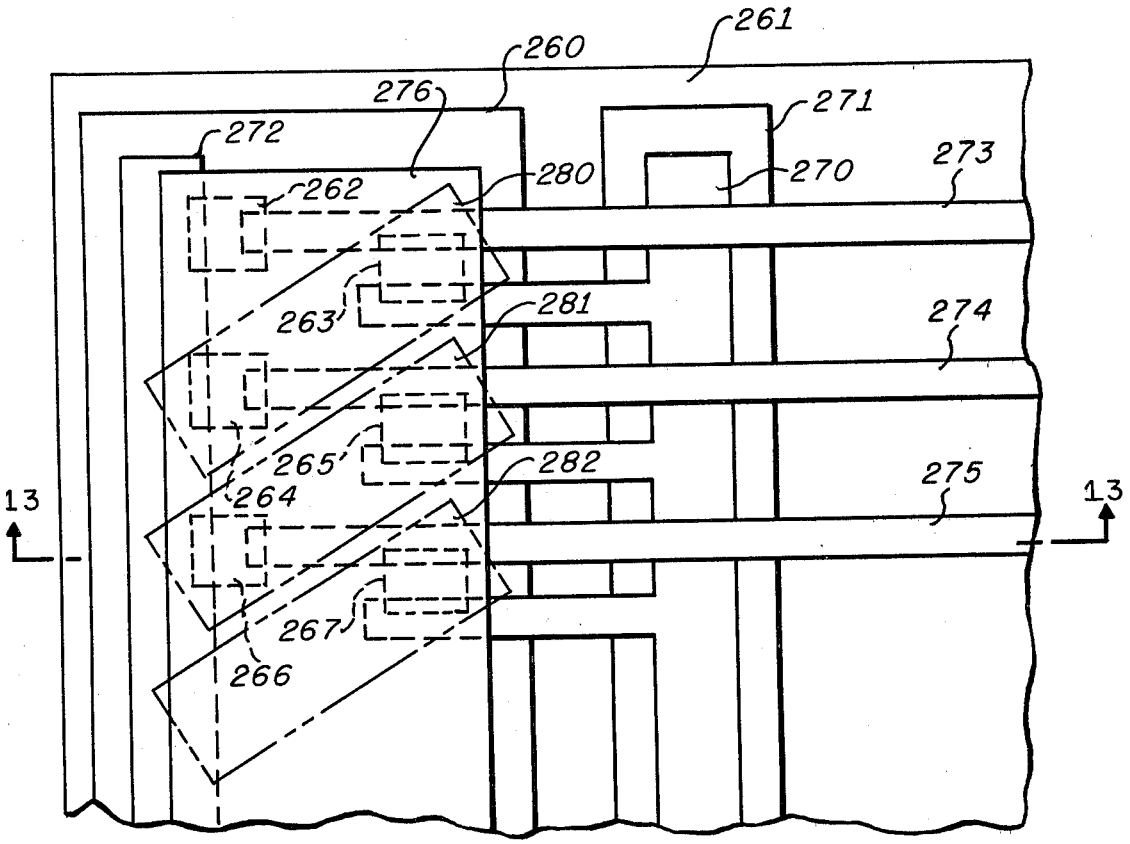
FIGS. 13A and 13B show construction of a preferred embodiment of the invention.
Figure 13B:
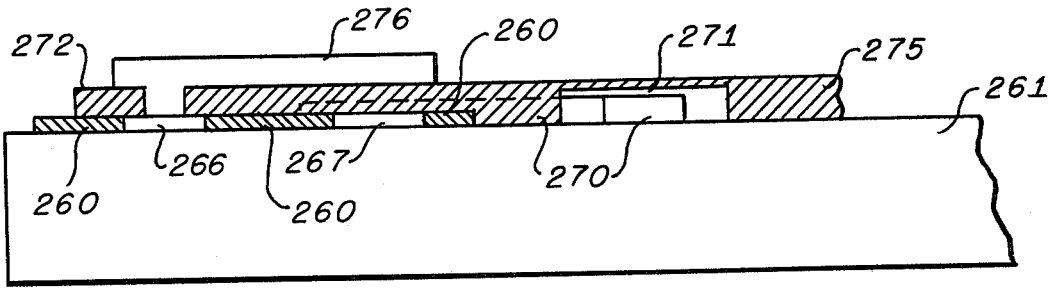

FIG. 13A shows an embodiment containing a second photoresistor corresponding to photoresistor 52, but without resistor 51 of FIG. 5. Opaque insulator 260 is screened onto substrate 261. Opaque insulator 260 has windows 262, 263, 264, 265, 266 and 267 which will form areas for the photoresistors. Ground conductor 270 may then be screened on having side pieces which extend to the areas of windows 263, 265, and 267. Insulating dielectric 271 may then be screened over the region of ground conductor 270 as shown. Common metal electrode 272 and electrodes 273, 274 and 275 may next be deposited, the latter three electrodes may be metal if desired. Finally, photoconducting material 276 may be screened on thus completing the construction. If desired, a final protective coating, not shown, may be added. FIG. 13B shows the construction of FIG. 13A in a cross-sectional view taken through section 13—13. Areas 280, 281 and 282 denote the cathodes of the scanning discharge tube to be used in conjunction with the assembly.

In operation, the areas delineated by windows 262, 264 and 266 form the coupling photoresistors while the area delineated by windows 263, 265 and 267 indicate the decoupling photoresistors. As can be seen in FIG. 13B, in the region of window 266, the photoresistor thus formed is an in-plane photoresistor as opposed to the through-plane photoresistors of FIG. 9B, since conduction through the photoresistor occurs primarily in a single plane. The dimensions of the photoresistors may be varied relative to one another to adjust the resistance of the coupling photoresistor relative to the decoupling photoresistor to optimize the values of the photoresistors in the resistive divider as previously described. The structure is arranged so that the decoupling photoresistor of one line, for example, that delineated by window 263 is illuminated at the same time and by the same cathode as the coupling photoresistor of the next line, namely, the photoresistor delineated by window 264. Alternatively, a second set of cathodes operated synchronously with the first set of cathodes may be used in a side-by-side configuration in which the cathodes used to illuminate the coupling photoresistors initiate their scan one cathode ahead of those cathodes used to illuminate the decoupling photoresistors. Clearly, such techniques can be extended to the addressing scheme of FIG. 7; additionally, it may be preferable to curve the conductors in such manner that scanning discharge tubes having a cathode arrangement as shown in FIGS. 10A or 10B may be used.

Figure 14:
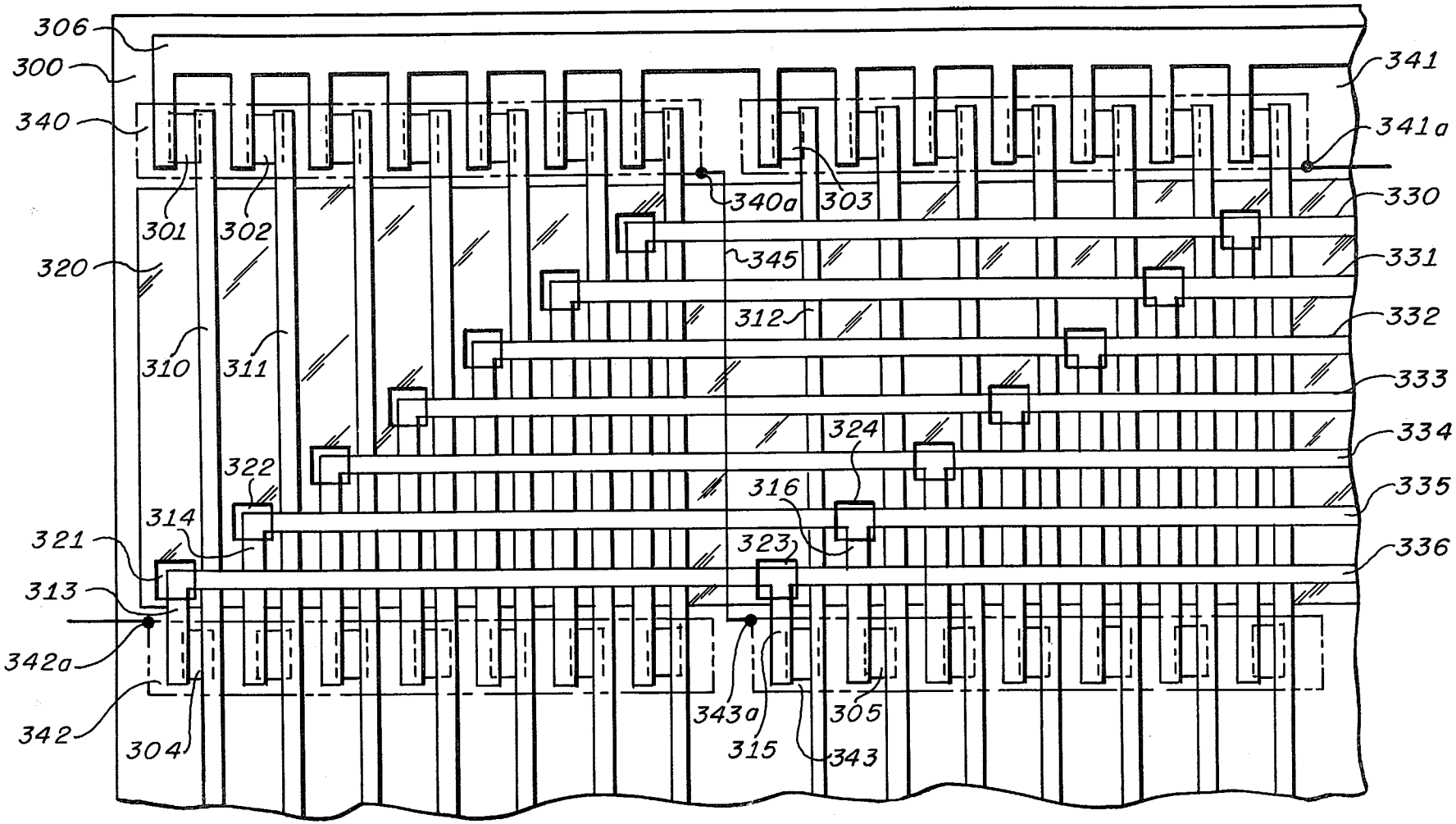
FIG. 14 shows an embodiment of the invention useful for addressing panels with large information content.

FIG. 14 shows an embodiment for illuminating the coupling photoresistors of one character column and the decoupling photoresistors of the previous character column substantially simultaneously as described for the multiple addressing scheme of FIG. 7. FIG. 14 is a view of the upper lefthand corner of such a display as seen from the viewing side of the display. The display is comprised of dielectric substrate 300 which may be, for example, glass, on which is first deposited photoconductors in rectangular squares including 301, 302, 303, 304 and 305. Ground conductor 306 is deposited in the pattern shown over the photoresistive areas; ground conductor 306 may be metal or other conductor. The vertically oriented conductors are deposited at the same time as ground conductor 306 and include vertical conductors 310, 311, 312 and others which extend from the upper rows of photoresistors to the lower rows of photoresistors. The remaining vertical conductors such as 313, 314, 315 and 316 are also deposited on the same layer as the previously mentioned vertical conductors 310, 311, etc. and are deposited over a portion of the lower photoresistors which include 304 and 305 making contact therewith. Insulator layer 320, delineated in outline, is deposited next over the conductors already laid down. Insulating layer 320 may be opaque or transparent and further includes windows such as 321, 322, 323 and 324 which are masked out portions of the insulating layer 320 that permit contact to the vertical conductors such as 313, 314, 315 and 316 previously deposited. The last layer of this part of the display may include the seven horizontal conductors 330–336 which when deposited over insulating layer 320 in the vicinity of windows such as 321, 322, 323 and 324 is electrically coupled with the previously deposited vertical conductors including vertical conductors 313–316.

Horizontal conductors 330–336 may be coupled on the righthand side to the seven vertical drivers which correspond, for example, to Y-leads 81–87 in FIG. 7. Light sources 340 and 341 are decoupling light sources and light sources 342 and 343 are coupling light sources. Light sources 340 and 343 are coupled to one another at terminals **340*a*, 343*a*, respectively via lead 345 to permit substantial simultaneity of the illumination they will provide. Terminals 341*a* and 342*a* are available for coupling to appropriate other light sources. It should be noted that light sources 340–343** as shown are extended light sources that will illuminate all of their corresponding photoresistors and thus permit the desired multiple addressing.

Alternatively, all four of the groups of photoresistors, including 301 to 305, may be deposited as large areas of photoconductors having approximately the outline and size of the corresponding light sources 340–343. In such an embodiment, it will then be necessary to deposit an additional opaque mask over the photoconductive area having windows corresponding in outline to the photoresistors shown in FIG. 14. Since those areas of the photoresistor which are not illuminated have a very high resistance, the darkened areas of the photoresistor will behave as essentially electrically open circuits, thus operating in the same manner as the embodiment shown in FIG. 14.

Figure 15:
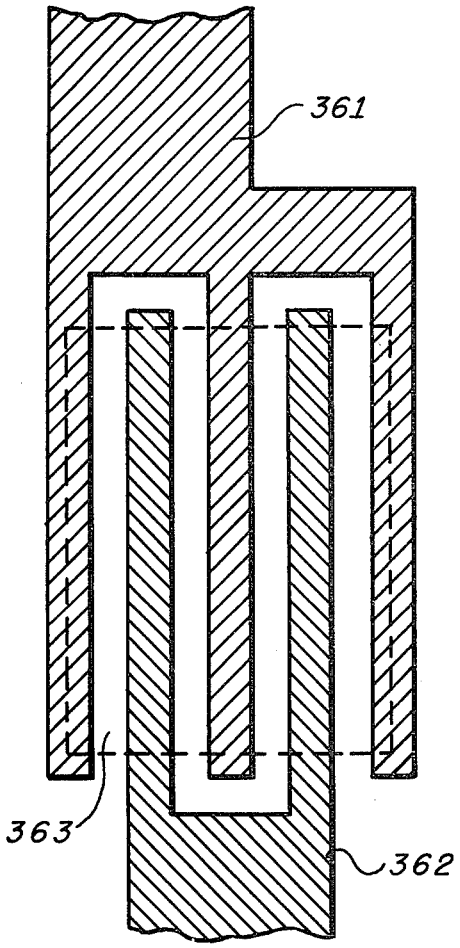
FIG. 15 shows a type of electrode useful in the construction of the invention.

Since a low illuminated resistance is required for the photoresistors to reduce the RC time constant of the display line circuits, a high effective aspect ratio is required for each photoresistor in order to maximize the photoconducting area. A high aspect ratio may be obtained as shown in FIG. 15 by the use of interdigital conductors 361 and 362. The area of photoresistor 363 thus available for in-plane conduction is increased since the perimeter of the conductors has been increased and the cross-sectional area of photoconducting material subject to in-plane current flow is consequently also increased.

Figure 16:
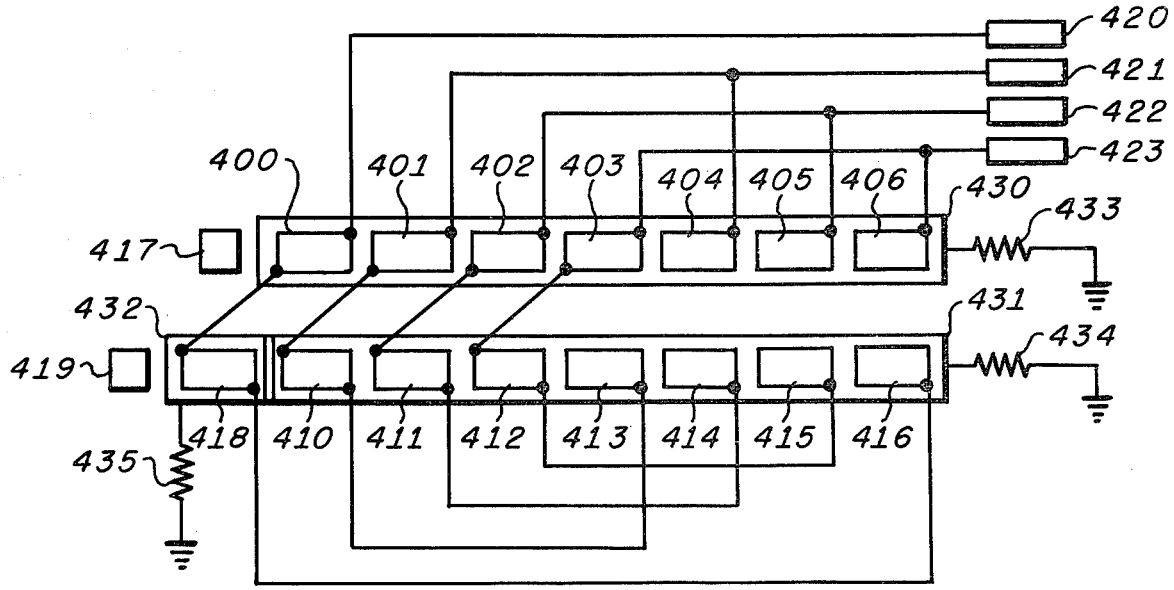
FIG. 16 shows the interconnection between cathodes in scanning gas discharge devices useful in the present invention.

FIG. 16 shows a circuit useful for interconnecting the cathodes of a scanning gas discharge tube in such a manner that those cathodes which are used to illuminate the coupling photoresistors and those cathodes which are used to illuminate the decoupling photoresistors are energized with a total of only four drive circuits. Coupling cathodes 400–406 are extended light sources which are used to illuminate groups of coupling photoresistors, and decoupling cathodes 410–416 are extended light sources used to illuminate groups of decoupling photoresistors in display panels of the type shown in FIGS. 7 and 14. Cathode 400, coupled to driver circuit 420, is used as the scan initiate cathode for cathodes 401–406. Cathode 401 is coupled to cathode 404 and further coupled to driver circuit 421. Cathode 402 is coupled to cathode 405 and driver circuit 422, while cathode 403 is coupled to cathode 406 and driver circuit 423 in the manner which is familiar to those skilled in the art of scanning gas discharge tubes. Cathode 400 is adjacent to cathode 417 which is operated in a d.c. mode and is normally included in scanning gas discharge tubes to facilitate the formation of a glow around scan initiate cathode 400. Cathode 410 is coupled to cathode 413, these being in turn coupled to cathodes 401 and 404 and driver circuit 421. Cathode 411 is coupled to cathode 414 which is in turn coupled to cathodes 402 and 405 and driver circuit 422, and cathode 412 is coupled to cathode 415 which is in turn coupled to cathodes 403 and 406 and driver circuit 423. Cathode 418 is an additional element which is not used for the illumination of photoresistors but serves as a scan initiate cathode for cathodes 410–415 and is also coupled to cathodes 416 and 400. Cathode 419 like cathode 417 is operated in a d.c. mode and facilitates the formation of a glow around scan initiate cathode 418. The four driver circuits 420–423 thus provide negative voltage pulses to both the coupling and decoupling cathodes via the intercoupling previously described; these voltage pulses are provided in a sequence appropriate for scanning. Anode 430 is located close to cathodes 400–406, anode 431 is located close to cathodes 410–416 and anode 432 is located close to cathode 418. All three anodes are coupled to ground through series resistors 433, 434, and 435.

When the operation of the tube is started in a scanning mode, a luminous glow is established sequentially at cathodes 400–406, and substantially simultaneously at cathodes 418 and 410–415. When the scanning sequence is reinitiated, a negative pulse is applied to cathodes 400, 418, and 416, and a glow is established at all three cathodes. The condition previously mentioned in reference to FIG. 7, wherein the last of the decoupling light sources 416 is energized at the same time coupling light source 400 is energized, namely, at the start of the addressing of a character row or character column, is thus satisfied.

It is important that the penultimate cathode in a particular sequence of cathodes, for example, cathode 415 not be coupled to the first cathode used to illuminate the photoresistors, for example, cathode 410, since due to the proximity of cathode 416, the glow transfer mechanism would cause cathode 415 to be illuminated at the same time the scanning sequence begins again, that is, when cathode 410 is energized. The circuitry described will thus satisfy the conditions for gas discharge scanning as long as the number of coupling or decoupling light sources is divisible by three or is one greater than a number divisible by three. If the number of such light sources is one less than a number divisible by three, then an additional cathode element which is not used for the illumination of photoresistors may be included in the rows of coupling and decoupling light sources in order to avoid the illumination of undesired segments as described hereinabove.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. A flat panel display comprising in combination:

a substrate;

an opaque insulating dielectric deposited on a portion of said substrate including:

a plurality of coupling window means for permitting the transmission of light therethrough; and a plurality of decoupling window means for permitting the transmission of light therethrough, said coupling and decoupling windows being arranged in side-by-side columns and offset from one another;

ground conductor having a substantially rectangular area and a longitudinal axis parallel to said columns of coupling and decoupling windows, and further having rectangular extensions therefrom having a longitudinal axis substantially perpendicular to the longitudinal axis of said first portion, said ground conductor being deposited upon said substrate and said extensions being deposited to intersect with said decoupling windows, insulating dielectric deposited over said rectangular area of said ground conductor;

first conductive means being substantially rectangular in form and having a longitudinal axis parallel to said columns of said coupling windows and further being deposited to intersect with said coupling windows;

a plurality of conductive grids having an axis substantially perpendicular to said coupling and decoupling window means and deposited over said insulating dielectric and said opaque insulating dielectric such that said plurality of conducting grids intersect with said decoupling and said corresponding coupling windows; and photoconductive material deposited over said conductive grids and said rectangular extensions of said ground electrode in the area of said opaque dielectric insulator to form, in conjunction with said plurality of coupling window means and decoupling window means, a plurality of voltage dividers.

2. The apparatus according to claim 1 wherein said substrate is glass.

3. The apparatus according to claim 2 wherein said photoconductive material is selected from the group of cadmium sulfide and cadmium selenide.

4. An improved flat panel display including a matrix display panel comprised of a first plurality of conductive leads, a second plurality of conductive leads so arranged and constructed to form a plurality of intersections with said first plurality of leads, and a plurality of pixel means coupled across said intersections for providing optical signals in response to electrical signals applied thereto, wherein the improvement comprises:

first input means coupled to said first plurality of leads for providing electrical signals thereto;

second input means coupled to said second plurality of leads for providing electrical signals thereto;

first plurality of coupling photoresistors;

first plurality of decoupling photoresistors, coupled, respectively, in series with said first plurality of coupling photoresistors with said first plurality of coupling photoresistors coupled to said first input means, and said first plurality of decoupling photoresistors coupled directly to ground potential, said first plurality of leads being coupled, respectively, between said first plurality of coupling photoresistors and said first plurality of decoupling photoresistors to form a plurality of voltage dividers;

a first plurality of coupling light source means, for illuminating, respectively, said first plurality of coupling photoresistors in sequence, to couple a first voltage in said first input means to, respectively, said first plurality of conductive leads and said pixel means thereacross; and a first plurality of decoupling light source means, for illuminating, respectively, said first plurality of decoupling photoresistors so that each of said first plurality of decoupling photoresistors is illuminated substantially upon termination of illumination of a corresponding one of said first plurality of coupling photoresistors, to decouple said first voltage in said first input means from a corresponding one of said first plurality of conductive leads and said pixel means thereacross.

5. The apparatus according to claim 4 further comprising resistors coupled in parallel, respectively, with said decoupling photoresistors.

6. The apparatus according to claim 4 further comprising:

a second plurality of coupling photoresistors;

a second plurality of decoupling photoresistors, coupled, respectively, in series with said second plurality of coupling photoresistors with said second plurality of coupling photoresistors coupled to said second input means, and said second plurality of decoupling photoresistors coupled directly to ground potential, said second plurality of leads being coupled, respectively, between said second plurality of coupling photoresistors and said second plurality of decoupling photoresistors to form a plurality of voltage dividers;

a second plurality of coupling light source means, for illuminating, respectively, said second plurality of coupling photoresistors in sequence, to couple a second voltage in said second input means to, respectively, said second plurality of conductive leads and said pixel means thereacross; and a second plurality of decoupling light source means, for illuminating, respectively, said second plurality of decoupling photoresistors so that each of said second plurality of decoupling photoresistors is illuminated substantially upon termination of illumination of a corresponding one of said second plurality of coupling photoresistors, to decouple said second voltage in said second input means from a corresponding one of said second plurality of conductive leads and said pixel means thereacross.

7. The apparatus according to claim 6 further comprising resistors coupled in parallel, respectively, with said first and second pluralities of decoupling photoresistors.

8. The apparatus according to claim 6 wherein said photoresistors comprise materials selected from the group of cadmium sulfide and cadmium selenide.

9. The apparatus according to claim 6 wherein said pixel means comprises a.c. electroluminescent material.

10. The apparatus according to claim 6 wherein said pixel means comprises d.c. electroluminescent material.

11. The apparatus according to claim 6 wherein said pixel means comprises an a.c. plasma panel.

12. The apparatus according to claim 6 wherein said light sources comprise self-scanning gas discharge tubes.

13. The apparatus according to claim 6 wherein said light sources comprise:

light emitting diodes; and electrical driver circuit means coupled to said light emitting diodes for sequentially energizing said light emitting diodes.

14. The apparatus according to claim 6 wherein said light sources comprise:

electroluminescent material; and electrical driver circuit means coupled to said electroluminescent material for sequentially energizing said electroluminescent material.

15. The apparatus according to claim 6 wherein said first input means comprises M addressing leads coupled in cyclical sequence to said first plurality of coupling photoresistors and said first plurality of decoupling photoresistors; and said first coupling light source and said first decoupling light source each comprises extended light source means for illuminating M adjacent photoresistors substantially simultaneously.

16. The apparatus according to claim 15 wherein said second input means comprises N addressing leads coupled in cyclical sequence to said second plurality of coupling photoresistors and said second plurality of decoupling photoresistors; and said second coupling light source and said second decoupling light source each comprises extended light source means for illuminating N adjacent photoresistors substantially simulatneously.

17. An improved flat panel display including a matrix display panel comprised of a first plurality of conductive leads, a second plurality of conductive leads so arranged and constructed to form a plurality of intersections with said first plurality of leads, and a plurality of pixel means coupled across said intersections for providing optical signals in response to electrical signals applied thereto, wherein the improvement comprises:

first input means coupled to said first plurality of leads for providing electrical signals thereto;

second input means coupled to said second plurality of leads for providing electrical signals thereto;

a first plurality of photoresistors;

a first plurality of fixed resistors, coupled, respectively, in series with said first plurality of photoresistors with said first plurality of photoresistors coupled to said first input means, and said first plurality of fixed resistors coupled directly to ground potential, said first plurality of leads being coupled, respectively, between said first plurality of photoresistors and said first plurality of fixed resistors to form a plurality of voltage dividers; and a plurality of light source means, for illuminating, respectively, said first plurality of photoresistors in sequence.

* * * * *